United States Patent [19]

Torres et al.

[11] Patent Number: 5,022,799

[45] Date of Patent: Jun. 11, 1991

[54] COKE DRUM DRILL STEM ALIGNMENT DEVICE

[75] Inventors: Daniel L. Torres, Bellingham; Timothy J. Murphy; Guy A. Maakad, both of Ferndale; Jeffrey R. Roberts, Bellingham; Kent S. Murray, Everson, all of Wash.

[73] Assignee: Atlantic Richfield Company, Los Angeles, Calif.

[21] Appl. No.: 451,917

[22] Filed: Dec. 15, 1989

[51] Int. Cl.[5] ..... B23B 35/00; B23B 41/00

[52] U.S. Cl. ..... 408/1 R; 175/220; 408/59; 408/80

[58] Field of Search ..... 408/1 R, 79, 80, 81, 408/83, 107, 104, 105, 234, 59; 175/79, 203, 220

[56] References Cited

U.S. PATENT DOCUMENTS

| | | | |
|---|---|---|---|
| 942,581 | 12/1909 | Neal | 175/220 |
| 1,281,420 | 10/1918 | Reid | 408/59 |
| 2,764,387 | 9/1956 | Dionisotti | 175/220 |
| 3,331,266 | 7/1967 | Brooks | 408/80 |
| 4,874,046 | 10/1989 | Hurd | 408/80 |

FOREIGN PATENT DOCUMENTS

| | | | |
|---|---|---|---|
| 63630 | 6/1941 | Norway | 408/80 |

*Primary Examiner*—Z. R. Bilinsky

*Attorney, Agent, or Firm*—Nilsson, Robbins, Dalgarn, Berliner, Carson & Wurst

[57] ABSTRACT

Apparatus and methods for alignment and mounting in position of a drill stem provided at one end with a cutting tool for use in removing coke from a coke drum. The drill stem is provided in the vicinity of the cutting tool with a drill stem guide carried on a slidably mounted plate. A flange on the drill stem is provided to prevent movement of the plate below a particular point. In a preferred embodiment, automatic clamping means are provided to attach the plate to an end flange on the coke drum when the drill stem guide has been lowered into the coke drum a sufficient distance so that the flange on the drill stem is disengaged from direct or indirect contact with the plate and/or connecting elements of the clamping means provided on an upper surface of the plate.

17 Claims, 3 Drawing Sheets

COKE DRUM DRILL STEM ALIGNMENT DEVICE

BACKGROUND OF THE INVENTION

This invention relates to methods and apparatus for use in connection with the preparation of coke from crude petroleum products.

A "delay coker" is an apparatus for the preparation of coke from the heaviest portion of crude oil (commonly referred to as "bunker" fuel). The crude is generally heated to a temperature of about 800–900° C. and then fed into the bottom of a coke drum. The coke drum has a diameter on the order of 25 feet and may be 80–90 feet high. At an elevated pressure (e.g., 30 pounds or more), the heated crude is thermally decomposed to leave a coke residue. During the thermal decomposition, lighter products such as hydrocarbons gases, gasoline and jet fuel, are recovered from the top of the coke drum. The decomposition process takes on the order of 16–20 hours to complete.

The solid residue is treated with steam to remove any entrained volatile hydrocarbons. The residue is then cooled down with water. Finally, the coke drum is opened at both the top and the bottom, and the solid product is drilled out for recovery. A typical drilling procedure employs a rotating high pressure water drill (for example, using 3000 lb/in$^2$ pressure).

It has heretofore been necessary after lowering the stem of the drilling device into the drum to manually mount the drill in position, for example using some type of collar means. In one arrangement, a two-piece hinged collar having a generally circular shape was used to align and mount the drill stem. The collar was hoisted onto the drum in an open position, after which the two generally semicircular halves of the collar connected at one end were manually engaged around the drill by swinging them together. The collar was finally clamped to a flange on the top of the coke drum to fix the drill stem into position. The two halves of the collar were suitably joined together at one end by pins, so that the arms could be swung away from the position of engagement when not in use.

A principal disadvantage of the known arrangements for aligning and mounting the drill stem is the need for manual adjustment of the collar. Because of the heat generated in the coke drum, the top flange of the coke drum and the collar itself could be quite hot. Moreover, during the engagement and clamping operations, workers could be exposed to steam and residual heated hydrocarbons escaping from the steam-treated solid materials in the drum. In addition, movement of the drill stem could cause the collar to slide out of engagement position or off the top flange of the coke drum if it were not already clamped securely in place.

Accordingly, it is an object of the present invention to provide apparatus and methods for bringing the drill stem into engagement and proper alignment with the top end of a coke drum, which apparatus and methods would eliminate the need for direct operator contact with the coke drum and/or associated elements.

SUMMARY OF THE INVENTION

In accordance with the present invention, apparatus and methods are provided for alignment and mounting of the drill stem without direct operator contact. The drill stem is provided in the vicinity of the cutting tool with a drill stem guide carried on a slidably mounted plate. A flange on the drill stem is provided to prevent movement of the plate below a particular point. In a preferred embodiment, automatic clamping means are provided to attach the plate to an end flange on the coke drum when the drill stem guide has been lowered into the coke drum a sufficient distance to permit disengagement of the flange on the drill stem from connecting elements of the clamping means provided on an upper surface of the plate.

DETAILED DESCRIPTION OF THE INVENTION

Figure 1:
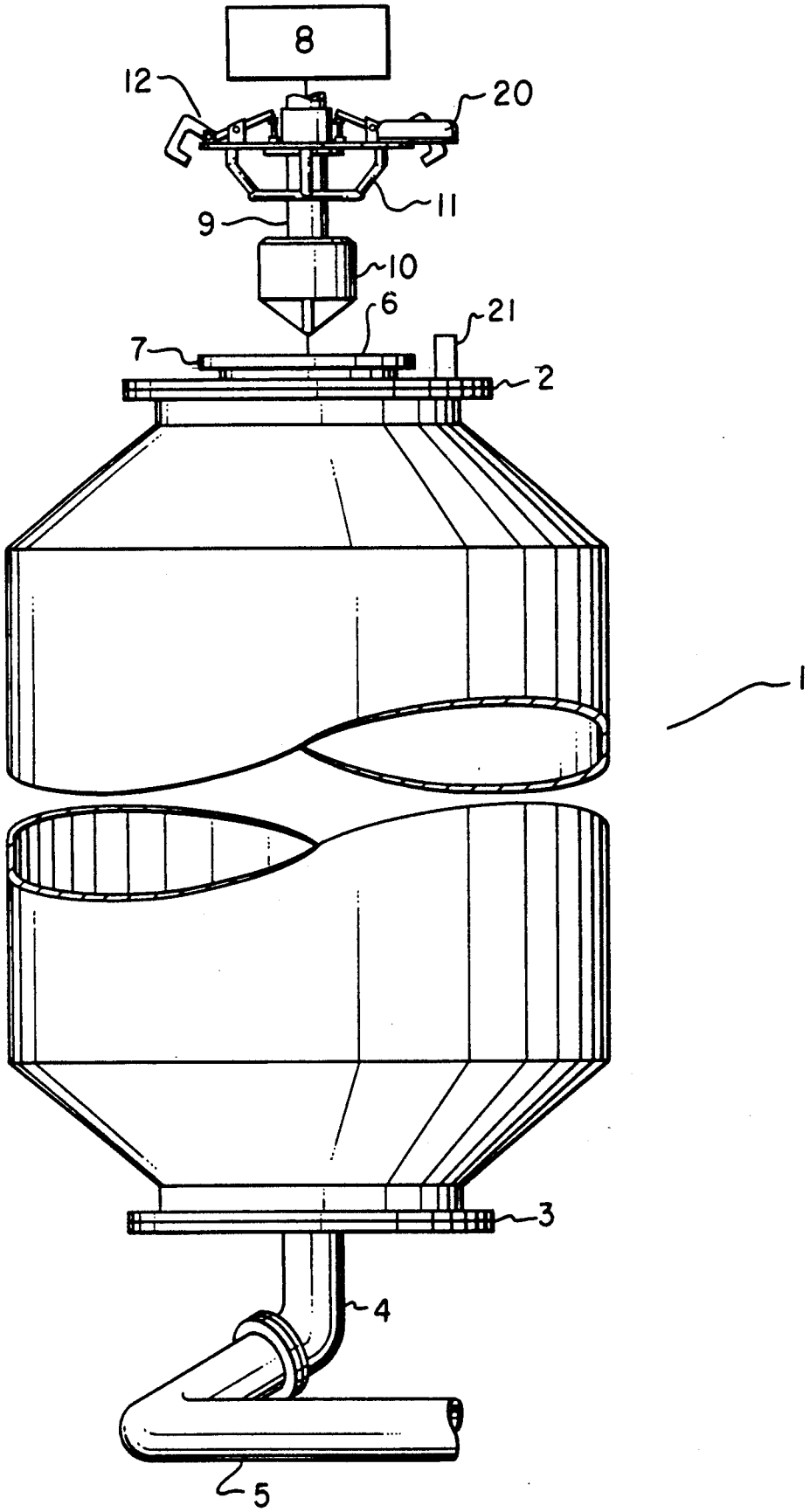
FIG. 1 illustrates an embodiment of the apparatus of the invention means in schematic form, in conjunction with a corresponding coke drum.

Referring to FIG. 1, a coke drum 1 is illustrated with an upper lid 2, a lower lid 3, a feed inlet 4 for introduction of crude and a feed line 5. An aperture 6 with an end flange 7 is provided in the upper lid 2. A fluid source 8 is provided at one end of the drill stem 9; a cutting tool 10 is provided at a second, opposite end of the drill stem 9. The alignment device of the invention (generally depicted in FIG. 1 at 11) is shown for purposes of clarity as comprising a single clamping device (generally depicted at 12) and a first rotational stop 20 adapted to engage a second rotational stop 21, the latter being provided on the upper lid 2 of the coke drum 1, laterally displaced from the aperture 6 and the end flange 7.

Figure 2:
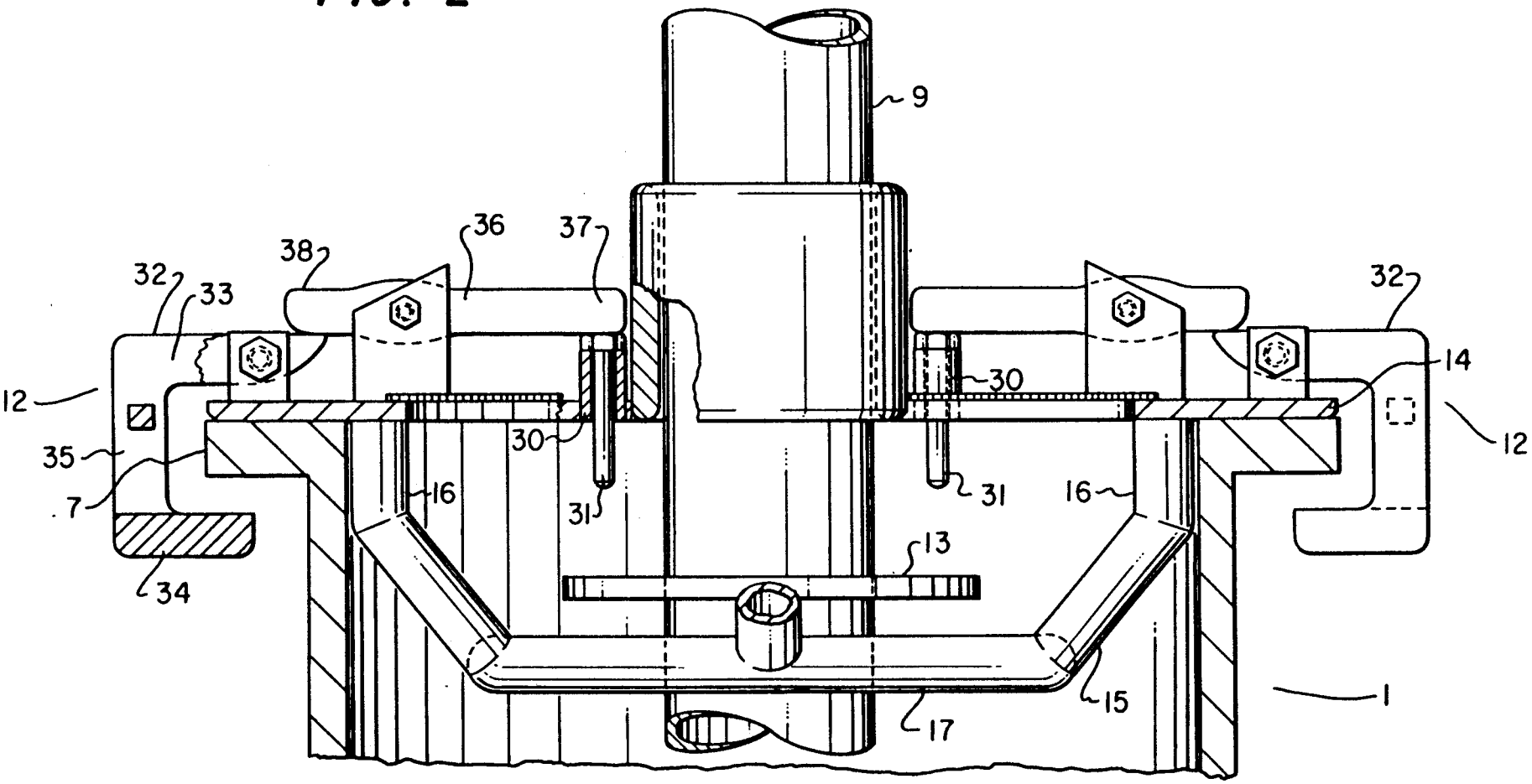
FIG. 2 is a side cross-section view of an embodiment of the inventive apparatus.
Figure 3:
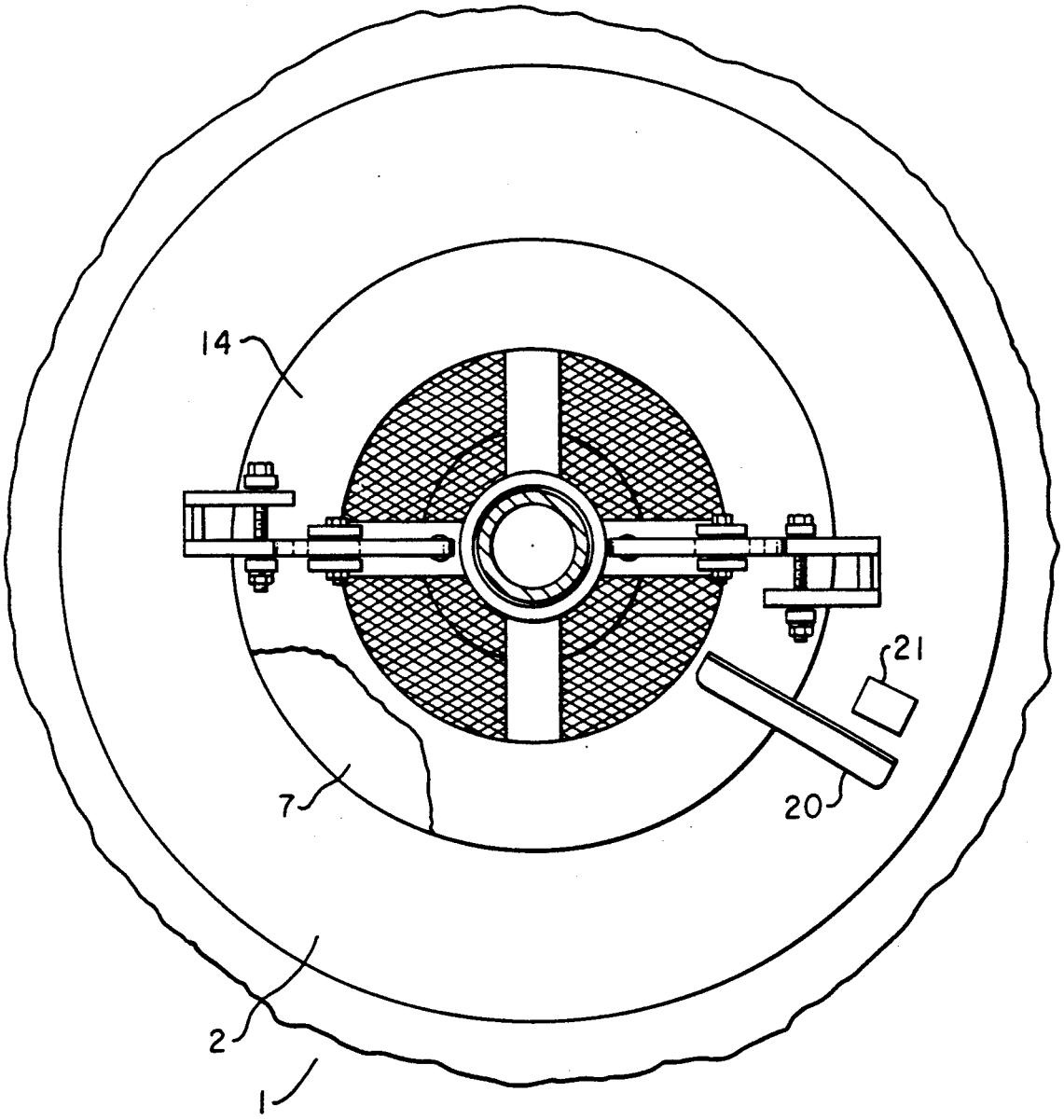
FIG. 3 is a top perspective view of an embodiment of the inventive apparatus illustrating the rotational stops.

FIG. 2 illustrates a preferred embodiment of the inventive apparatus, comprising a pair of clamping devices 12. A flange 13 is mounted on the drill stem 4 between the cutting tool 10 and the fluid inlet 8. A generally circular plate 14 is mounted slidably on the drill stem 9 between the flange 13 and the fluid inlet 8, and is supported by the flange 13 when the drill stem is not in engagement with the coke drum (the situation depicted in FIG. 1). Preferably (as illustrated in FIG. 3), a substantial portion of the surface area of the plate 14 comprises webbed metal to permit escape of steam. A guide structure 15 associated with plate 14 is provided to facilitate alignment of the drill stem 9 (and cutting tool 10) in the coke drum 1.

The guide structure 15 is suitably mounted on the underside of the plate 14, facing the flange 13, near the periphery of the plate 14 and extends generally normally from the plate 14. The guide structure 15 is designed so as to be received in the aperture 6 of the coke drum 1. In particular, the coke drum 1 is provided with a generally cylindrical passage which is aligned with the longitudinal axis of the drill stem 9 and of sufficient diameter to receive the guide structure 15. In a preferred embodiment, the guide structure 15 comprises a plurality of guide legs 16 attached at one end to a face of the plate, thereby forming a circular pattern. The opposite ends of the guide legs 16 may then suitably be attached to a generally circular nose piece 17 with a diameter less than that of the plate 14 or the aperture 6. In a preferred embodiment, this nose piece 17 is formed of tubing with a roughly circular cross-section. This arrangement facilitates moving the guide structure 11 into the aperture 6 and reduces damage to the internal lining (i.e., cladding) of the coke drum 1.

The cutting tool 10 at the end of the drill stem 9 is typically also of a generally cylindrical shape and has an outside diameter which is less than the diameter of the nose piece 17. Thus, when the alignment device 11 is lowered into the aperture 6 in the upper portion of the coke drum 1, the guide structure 11 serves to align the device in a manner such that the concentrically mounted cutting tool 10 is in the appropriate position for operative insertion into the coke drum 1 (for example, into a nozzle located in the lower portion of the aperture 6). In addition, because the diameter of the cutting tool 10 is less than that of the nose piece 17, it is possible to move the drill stem 9 relative to the guide structure 11 such that the cutting tool 10 passes through the nose piece 17.

In accordance with a further embodiment of the present invention as illustrated in FIG. 3, the apparatus is provided with a first rotation stop 20 extending radially outwardly therefrom, for example, from the plate 14, to prevent rotation of the alignment device induced by rotation of the drill stem 9. A corresponding second rotation stop 21 is provided on the upper surface of the coke drum 1 (for example, on upper lid 2) so as to contact the first rotation stop 20 at a particular position in the rotation of the device. In this manner, rotation of the device is limited. In one embodiment, the first rotation stop 20 may comprise an arm projecting out from the plate 13, and the second rotation stop 21 may comprise an arm projecting up from the top surface of the coke drum 1 and laterally displaced from the end flange 7.

In accordance with a preferred embodiment of the invention, the plate 14 is further provided with at least one, and preferably several, boreholes 30 extending through the plate 14 at a location aligned with a portion of the flange 13. A pin 31 is slidably positioned in each borehole 30; a head at the upper portion of the pin 31 is designed to retain the pin 31 in the borehole 30. A generally C-shaped clamp 32 is positioned generally radially outwardly from the plate 14. The clamp 32 has an upper arm 33 pivotally connected to the top surface of the plate 14, a lower arm 34 extending beneath the bottom surface of the plate 14 when the clamp 32 is in an engaged position (as illustrated in FIG. 2), and a connecting arm 35 extending past the outer periphery of the plate 14. A lever 36 is pivotally mounted by its midportion to the top surface of the plate 14. The inner end 37 of the lever 36 is positioned so as to cover the head of the pin 31, whereas the outer end 38 is positioned so as to engage as a cam the free end of the upper arm 33 of the locking clamp 32. The arrangement is such that when the flange 13 is urged against the lower end of pin 31, the head of the pin 31 causes the lever 36 to pivot; as the outer end 38 of the lever 6 pivots down, it causes the upper arm 33 of the C-shaped clamp 32 to swing the lower arm 34 radially outwardly and thus, out of the engaged position (as illustrated in FIG. 1).

In general, end flange 7 is positioned at the upper end of the coke drum 1 surrounding the aperture 6. The outside diameter of the end flange 7 is approximately the same as that of the plate 14, and the thickness of the end flange 7 sufficiently small so that the lower arm 34 of the locking clamp 32 may engage the lower surface of the end flange 7 when it is swung into engagement position (as illustrated in FIG. 2).

In operation, the plate 14 is directly or indirectly carried on the flange 13 positioned on the drill stem 9. When the plate 14 is lowered into abutment with the upper end flange 7 of the coke drum 1, the drill stem 9 is aligned with the assistance of the guide structure 11. The drill stem 9 is then lowered through the guide structure 11 and into the coke drum 1, thereby also bringing the flange 13 on the drill stem out of contact (direct or indirect) with the plate 14. Once the plate 14 is in abutment with the coke drum end flange 7, the device may be fixed in position (for example, by associated clamp means 12 or by external clamps separately provided).

With the preferred embodiment including generally C-shaped clamp means 32 as described previously, when the flange 13 on the drill stem 9 is moved out of contact with the bottom end of pin 31, the pin 31 in aperture 30 of plate 14 no longer remains in the extended position illustrated in FIG. 1 and the head of the pin 31 does not urge inner end 37 of lever 36 upward. Therefore, the inner end 37 of the lever 36 pivots down while the outer end 38 of the lever 36 pivots up, whereby the upper portion 33 of clamp 32 follows to move the lower portion 34 of clamp 32 below the end flange 7 on the coke drum 1 (i.e., the engagement position illustrated in FIG. 2).

From the foregoing description, one skilled in the art can readily ascertain the essential characteristics of the invention and, without departing from the spirit and scope thereof, can adapt the invention to various usages and conditions. Changes in form and substitution of equivalents are contemplated as circumstances may suggest or render expedient, and although specific terms have been employed herein, they are intended in a descriptive sense and not for purposes of limitation.

What is claimed is:

1. Apparatus for aligning a drill stem with an aperture in an upper portion of a coke drum, said drill stem having a cutting tool at a first end and a fluid inlet at a second opposite end, said aperture having an opening including an end flange at an upper portion thereof and being adapted to operatively receive said cutting tool in a lower portion thereof, said apparatus comprising:

a flange fixedly mounted on said drill stem between said cutting tool and said fluid inlet;

a plate slidably mounted on said drill stem above said flange, said plate being no smaller than said opening in said aperture, said flange preventing said plate from sliding below a first position on said drill stem by engaging a first face thereof; and a drill stem guide mounted on said plate and extending normally from said first face of said plate in substantial alignment with a vertical axis of said drill stem, said guide being designed to fit in said aperture and to align said drill stem for receipt of said cutting tool in said lower portion of said aperture.

2. Apparatus according to claim 1, wherein said opening of said aperture and said plate are both substantially circular.

3. Apparatus according to claim 1, wherein said guide comprises a plurality of guide legs each having a first end and a second end, each of said guide legs being attached at said first end thereof to said first face of said plate.

4. Apparatus according to claim 3, wherein said guide legs are disposed on said plate in a substantially circular pattern.

5. Apparatus according to claim 4, wherein said guide legs are contoured so that said respective second ends form a circular pattern having a smaller diameter than that formed by said first ends.

6. Apparatus according to claim 5, further comprising a substantially circular nose piece attached to said respective second ends of said guide legs.

7. Apparatus according to claim 6, wherein said nose piece comprises a tubular ring.

8. Apparatus according to claim 1, further comprising a first rotation stop extending generally radially outwardly from said plate and a second rotation stop extending generally normally from said upper portion of said coke drum and laterally displaced from said end flange, said first and second rotation stops being adapted to engage one another so as to limit rotation of said plate.

9. Apparatus according to claim 1, further comprising clamping means for attaching said plate to said end flange.

10. Apparatus according to claim 9, wherein said plate further comprises at least one borehole aligned on a portion of said flange and extending from said first face of said plate through said plate to a second face of said plate, and said clamping means comprises:

a pin positioned slidably in said borehole, said pin having a lower end extending below said first face of said plate and an upper end provided with a head adapted to abut said second face of said plate and provide retention of said pin in said borehole;

a lever pivotally mounted at a midportion thereof on said second face of said plate, said lever extending radially outward from said drill stem above said second face of said plate, said lever having an inner end positioned in covering relationship with said pin and an outer end; and a generally C-shaped clamp positioned generally radially outwardly from said lever, said C-shaped clamp having an upper arm, a lower arm and a connecting arm, said upper arm being pivotally connected at a midportion thereof to said second face of said plate and having an inner end and an outer end, said outer end of said lever being in a covering relationship with said inner end of said upper arm, said outer end of said upper arm extending radially outwardly beyond said second face of said plate and being connected to a first end of said connecting arm, said lower arm being connected to a second end of said connecting arm and extending substantially normally from said connecting arm and substantially parallel to said upper arm.

11. Apparatus according to claim 10, wherein said lower arm extends beneath said first face of said plate in a first position.

12. Apparatus according to claim 11, wherein the components are arranged so that urging said flange against said lower end of said pin causes said pin to slide in said borehole and moves said head of said pin into contact with said inner end of said lever, whereby said inner end of said lever is displaced upwardly and said outer end of said lever is displaced downwardly into contact with said inner end of said upper arm of said generally C-shaped clamp, thereby swinging said lower arm radially outwardly from said first position into a second position in which said lower arm does not extend beneath said first face of said plate.

13. Apparatus according to claim 12, wherein said lower arm is maintained in said second position until said first face of said plate is brought into contact with said end flange, whereupon said flange is disengaged from said lower end of said pin and said lower arm is free to swing into said first position.

14. Apparatus according to claim 13, wherein said end flange has a sufficiently small thickness to permit engagement thereof by said lower arm when said lower arm is in said first position.

15. A method for aligning a drill stem on a longitudinal axis of a coke drum, said method comprising:

providing a drill stem guide on said drill stem;

introducing said drill stem provided with said drill stem guide into an aperture in an upper end of said coke drum, said aperture having an axial bore with an axis substantially coincident with said longitudinal axis and an opening including an end flange at an upper portion thereof;

registering said drill stem guide with said axial bore so as to align said drill stem; and fixing said drill stem guide in position relative to said aperture by attaching said drill stem guide to said end flange with at least one clamp external to said aperture.

16. A method according to claim 15, wherein said drill stem is provided with a cutting tool at a first end thereof, said drill stem guide is provided on said drill stem in proximity to said cutting, tool, and said method further comprises moving said cutting tool past said drill stem guide through said aperture into said coke drum.

17. A method according to claim 15, wherein said fixing comprises rotating said drill stem guide into engagement with a rotation stop provided on said coke drum.

* * * * *